United States Patent [19]

Howard et al.

[11] Patent Number: 4,504,835

[45] Date of Patent: Mar. 12, 1985

[54] LOW SIDELOBE, HIGH EFFICIENCY MIRROR ANTENNA WITH TWIST REFLECTOR

[75] Inventors: Dean D. Howard, Fort Washington, Md.; David C. Cross, Alexandria, Va.

[73] Assignee: The United States of America as represented by the Secretary of the Navy, Washington, D.C.

[21] Appl. No.: 389,139

[22] Filed: Jun. 15, 1982

[51] Int. Cl.[3] ..... H01Q 19/00

[52] U.S. Cl. ..... 343/755; 343/756; 343/761; 343/781 P

[58] Field of Search ..... 343/756, 781 P, 781 CA, 343/755

[56] References Cited

U.S. PATENT DOCUMENTS

| | | | |
|---|---|---|---|
| 2,958,863 | 11/1960 | Ramsay | 343/756 |
| 3,005,983 | 10/1961 | Chandler | 343/756 |
| 3,281,850 | 10/1966 | Hannan | 343/756 |
| 3,771,160 | 11/1973 | Laverick | 343/909 |
| 3,797,020 | 3/1974 | Roger et al. | 343/779 |
| 3,924,239 | 12/1975 | Fletcher et al. | 343/909 |
| 4,220,957 | 9/1980 | Britt | 343/756 |
| 4,253,100 | 2/1981 | Commault et al. | 343/756 |

FOREIGN PATENT DOCUMENTS

| | | | |
|---|---|---|---|
| 2828807 | 1/1979 | Fed. Rep. of Germany CA | 343/781 |
| 1330175 | 9/1973 | United Kingdom | 343/756 |

*Primary Examiner*—E. Lieberman
*Assistant Examiner*—K. Ohralik
*Attorney, Agent, or Firm*—Robert F. Beers; William T. Ellis; Alan P. Klein

[57] ABSTRACT

A mirror antenna employing a continuous mirror without a hole. A feed horn and an electromagnetic lens, located behind a rotatable twist reflector (the mirror), collimates a beam toward a polarized reflector located near the twist reflector and tilted to aim energy toward the twist reflector. Energy reflected back toward the polarized reflector from the twist reflector passes through the polarized reflector to free space.

5 Claims, 1 Drawing Figure

INDIRECT FEED FOR THE TWO-AXIS MIRROR ANTENNA (ONLY ONE AXIS ILLUSTRATED)

INDIRECT FEED FOR THE TWO-AXIS MIRROR ANTENNA (ONLY ONE AXIS ILLUSTRATED)

LOW SIDELOBE, HIGH EFFICIENCY MIRROR ANTENNA WITH TWIST REFLECTOR

BACKGROUND OF THE INVENTION

The present invention relates generally to antennas for radiofrequency energy, and more particularly to antennas required to produce electromagnetic beams over wide angles of coverage volume.

U.S. Pat. No. 4,070,678 issued to Richard L. Smedes on Apr. 1, 1976 discloses a two-axis mirror antenna. This antenna has a fixed axial feed which illuminates a fixed wire grid parabola supported by a radome. The feed polarization is parallel to the grid wires of the parabola. The parabola forms the energy into a beam aimed back toward a mirror surrounding the feed. The mirror is a "half-wave plate" which rotates polarization 90° and reflects the beam into space through a spherical lens which collimates the beam. This energy, being polarized orthogonal to the grid wires forming the parabola, flows through the parabola with negligible attenuation. The echo from targets reverses the procedure to be focused onto the feed. The beam is moved by tilting the mirror, giving a beam shift of approximately twice the mirror tilt angle.

The mirror antenna is a very effective device for rapid large angle beam scanning, but the hole in the mirror for the feed limits sidelobe performance and causes some loss.

SUMMARY OF THE INVENTION

It is therefore an object of this invention to obtain very low sidelobes with a two-axis mirror antenna.

Another object is to maximize the efficiency of a two-axis mirror antenna.

These and other objects of the invention are achieved by a mirror antenna which includes a feed horn for forming a linearly-polarized divergent beam of radiofrequency energy; an electromagnetic lens for simultaneously refracting and collimating the divergent beam; a fixed polarized reflector for reflecting the collimated beam; and a rotatably mounted twist reflector having a continuous reflecting surface for changing the direction of the reflected beam in accordance with the position of the twist reflector and for twisting its polarization by substantially 90° so that if the beam is directed back toward the polarized reflector, the beam passes through the polarized reflector to free space.

The use of a continuous reflecting surface in the mirror antenna design eliminates the loss of energy which occured in the prior art mirror antenna because of energy falling on the hole. It also eliminates the increase in sidelobes by the hole. The design allows a very low sidelobe device to collimate the beam with a minimum degradation of the pattern formed by the device. It does increase the overall antenna size, but this is a small price when low sidelobes are required.

Additional advantages and features will become apparent as the subject invention becomes better understood by reference to the following detailed description when considered in conjunction with the accompanying drawing wherein:

BRIEF DESCRIPTION OF THE DRAWING

The sole FIGURE illustrates an embodiment of the invention.

DESCRIPTION OF THE PREFERRED EMBODIMENT

Figure 1:
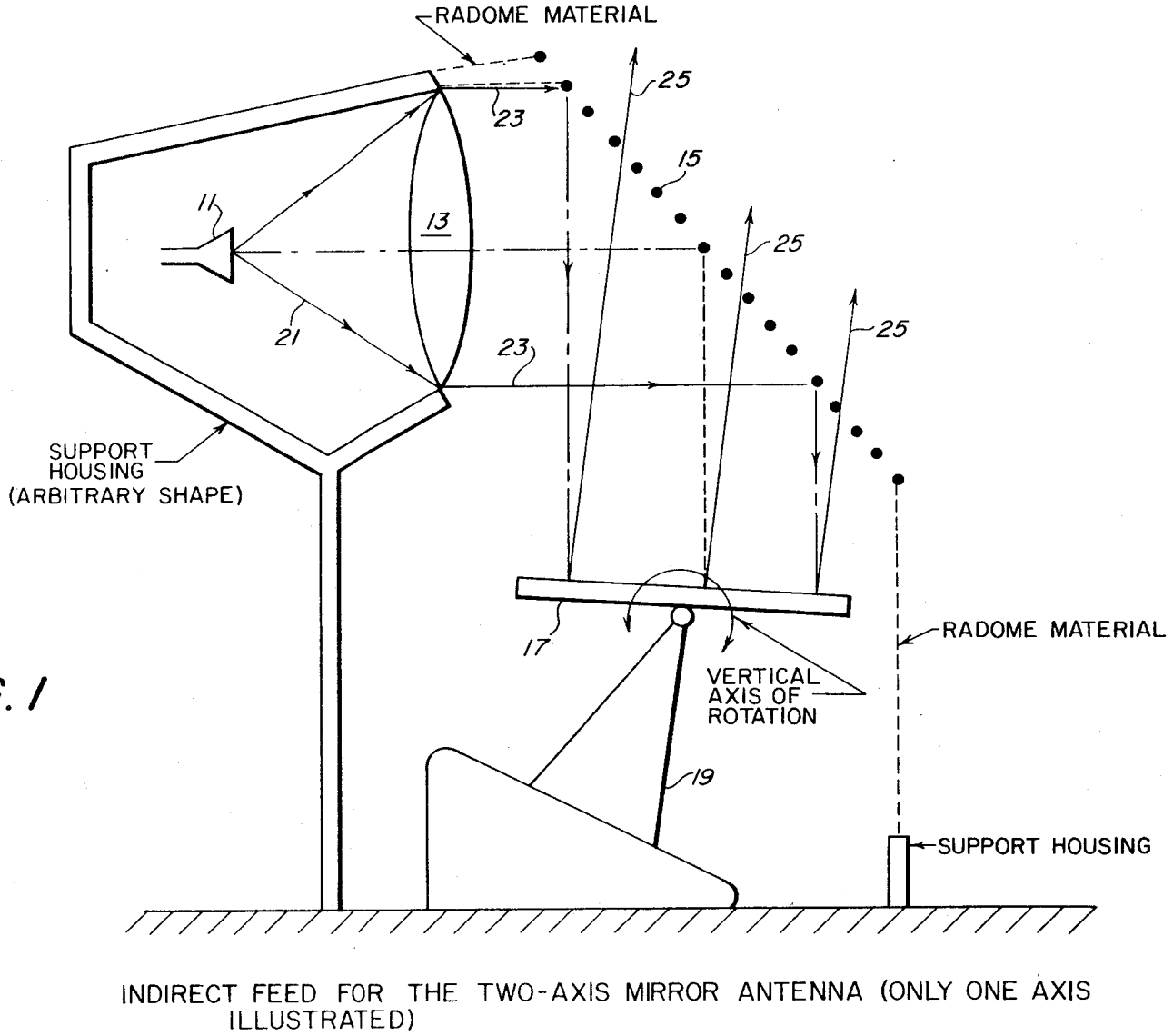

Referring to the FIGURE, the mirror antenna 10 includes a feed horn 11; an electromagnetic lens 13 disposed in the path of a beam from the feed horn; a polarized reflector 15, such as a grating, disposed in fixed spatial relationship to the electromagnetic lens; and a twist reflector 17 which has a continuous reflecting surface and is rotatably mounted in the reflecting path of the polarized reflector 15.

Suitble twist reflectors are described, for example, in the article "A Broad-Band Twist Reflector" by Lars G. Josefsson in *IEEE Trans. on Antennas and Propagation* (July 1971) pp. 552–554, whose disclosure is herewith incorporated by reference. The twist reflector 17 is mounted on a positioner 19 for rotation about two mutually perpendicular axes, such axes being perpendicular to the paper, and in the plane of the paper. A suitable positioner 19 is described, for example, in U.S. Pat. No. 3,374,977 issued to George Moy, Jr. on Mar. 26, 1968, herewith incorporated by reference.

In operation, the feed horn 11 is connected to a transmitter (not shown) and forms a linearly-polarized divergent beam 21 of radiofrequency energy which is simultaneously refracted and collimated by the electromagnetic lens 13 to produce a linearly-polarized collimated beam 23. The linearly-polarized collimated beam 23 illuminates the polarized reflector 15, the polarization being perpendicular to the paper, say "vertical". The radiation is then reflected onto the continuous surface of the twist reflector 17 which changes the direction of the linearly-polarized collimated beam in accordance with the position of the twist reflector, and twists the polarization of the radiofrequency energy in the collimated beam by 90°. That is, the polarization of the radiation 25 reflected from the twist reflector 17 is made horizontal, i.e., in the plane of the paper (the terms "vertical" and "horizontal" are used for convenience, not with any limiting force). Such radiation will, if directed back toward the polarized reflector 15, pass through to free space. By rotating the twist reflector 17 about mutually perpendicular axes, the beam 25 can be aimed into space over a large coverage volume.

The surface of the twist reflector 17 is continuous, unlike that of the mirror for the feed in the antenna assembly shown in the above-cited U.S. Pat. No. 4,070,678 wherein energy is lost to the hole in the mirror. Furthermore, the absence of a mirror hole permits a reduction in sidelobe level.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. A low sidelobe, high efficiency, mirror antenna comprising:

a feed horn for forming a linearly-polarized divergent beam of radiofrequency energy;

an electromagnetic lens disposed in the path of the linearly polarized divergent beam from the feed horn for simultaneously refracting and collimating the radiofrequency energy in the beam to produce a linearly-polarized collimated beam;

a polarized reflector disposed in fixed spatial relationship to the electromagnetic lens for reflecting the linearly-polarized collimated beam of radiofrequency energy; and a twist reflector having a continuous reflecting surface and rotatably mounted about two mutually perpendicular axes in the path of the reflected linearly-polarized collimated beam for changing the direction of the linearly-polarized collimated beam of radiofrequency energy in accordance with the position of the twist reflector and for twisting the polarization of the radiofrequency energy in the collimated beam by substantially 90° so that if the beam is directed back toward the polarized reflector, the beam passes through the polarized reflector to free space.

2. The mirror antenna as recited in claim 1, wherein said twist reflector includes positioner means for changing the position of said twist reflector.

3. The mirror antenna as recited in claim 2, wherein said positioner means comprises a positioner controllable about two mutually perpendicular axes.

4. The mirror antenna as recited in claim 3, wherein said positioner can position said twist reflector to scan said linearly-polarized collimated beam over an area both through and around said polarized reflector.

5. The mirror antenna as recited in claim 4, wherein said fixed spaced relationship of said polarized reflector includes positioning to reflect said linearly-polarized collimated beam at a right angle to the axis of said electromagnetic lens.

* * * * *